US011161166B2

(12) United States Patent
Park

(10) Patent No.: US 11,161,166 B2
(45) Date of Patent: Nov. 2, 2021

(54) FORGING METHOD AND FORGING APPARATUS

(71) Applicant: BUMCHUN PRECISION CO., LTD., Ansan (KR)

(72) Inventor: Yang Il Park, Seoul (KR)

(73) Assignee: BUMCHUN PRECISION CO., LTD., Ansan (KR)

( * ) Notice: Subject to any disclaimer, the term of this patent is extended or adjusted under 35 U.S.C. 154(b) by 434 days.

(21) Appl. No.: 16/328,882

(22) PCT Filed: Aug. 5, 2016

(86) PCT No.: PCT/KR2016/008657
§ 371 (c)(1),
(2) Date: Feb. 27, 2019

(87) PCT Pub. No.: WO2017/146322
PCT Pub. Date: Aug. 31, 2017

(65) Prior Publication Data

US 2019/0210092 A1 Jul. 11, 2019

(30) Foreign Application Priority Data

Feb. 24, 2016 (KR) ..... 10-2016-0021681

(51) Int. Cl.
*B21D 37/08* (2006.01)
*B21K 27/02* (2006.01)
(Continued)

(52) U.S. Cl.
CPC ..... *B21D 37/08* (2013.01); *B21J 5/02* (2013.01); *B21J 5/08* (2013.01); *B21K 27/02* (2013.01); *B21K 27/06* (2013.01)

(58) Field of Classification Search
CPC ..... B21D 37/08; B21D 35/001; B21D 43/05; B21D 43/02; B21D 43/04; B21D 43/06;
(Continued)

(56) References Cited

U.S. PATENT DOCUMENTS 2,610,390 A * 9/1952 Locke ..... B21D 53/36 29/874
5,271,140 A * 12/1993 Futamura ..... B21D 43/05 29/33 K
6,247,227 B1 * 6/2001 Ziberna ..... B65D 73/02 29/786

FOREIGN PATENT DOCUMENTS

JP 2000176571 A * 6/2000

OTHER PUBLICATIONS

Translation of JP-2000176571-A (Year: 2000).*

* cited by examiner

*Primary Examiner* — Shelley M Self
*Assistant Examiner* — Teresa A Guthrie

(57) ABSTRACT

The present invention relates to a forging method and a forging apparatus, capable of: reducing the amount of tray plates used during the forging of materials by reducing the width from front to back of the tray plates by fixing only the rear of the materials to the tray plates for fixing the materials; and minimizing the amount of materials used, by compression-molding products by fixing, to the tray plates, the materials having a minimum size necessary for the fmal products, the present invention comprising: a press having upper and lower molds; a tray plate supply means for supplying, to the top rear of the lower mold, tray plates to be vertically movable from one side to the other side by a pitch and to be spaced from the upside of the lower mold; a punching unit provided at one side of the upper and lower molds so as to continuously punch material fixing hole parts in the tray plates; a material plate supply means provided at the front of the other side of the punching unit so as to supply material plates by a pitch to under the material fixing hole parts of the tray plates and, at the same time, form penetrating protrusion parts, which penetrate into the material fixing
(Continued)

hole parts, on the rear top of the material plate in each pitch, which is moved by a pitch; a cutting and compressive fixing unit provided on the upper and lower molds at the other side of the punching unit so as to cut the material plates, which are inserted into the material fixing hole parts of the tray plates, by a pitch and, at the same time, allow the penetrating protrusion parts formed at the rear of the cut materials to penetrate into the material fixing hole parts, thereby compressively fixing same; and a compression molding unit provided on the upper and lower molds at the other side of the cutting and compressive fixing unit so as to compression-mold the materials being transferred.

12 Claims, 9 Drawing Sheets

(51) Int. Cl.
*B21K 27/06* (2006.01)
*B21J 5/08* (2006.01)
*B21J 5/02* (2006.01)

(58) Field of Classification Search
CPC ..... B21D 43/003; B21D 39/032; B21J 5/02; B21J 5/08; B21J 9/022; B21J 13/02; B21K 27/02; B21K 27/06; B21K 27/00; B23Q 3/002; B23Q 3/005; Y10T 29/49943; Y10T 29/4992; B23P 11/005
USPC ..... 72/333, 404, 405.01
See application file for complete search history.

[FIG. 1]
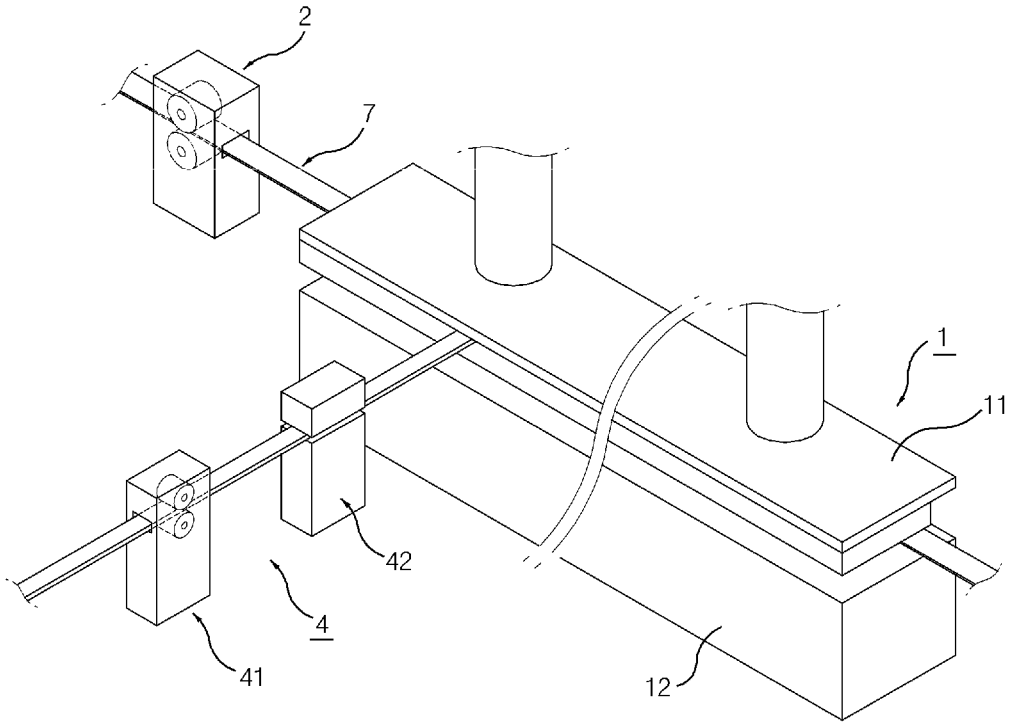

[FIG. 2]
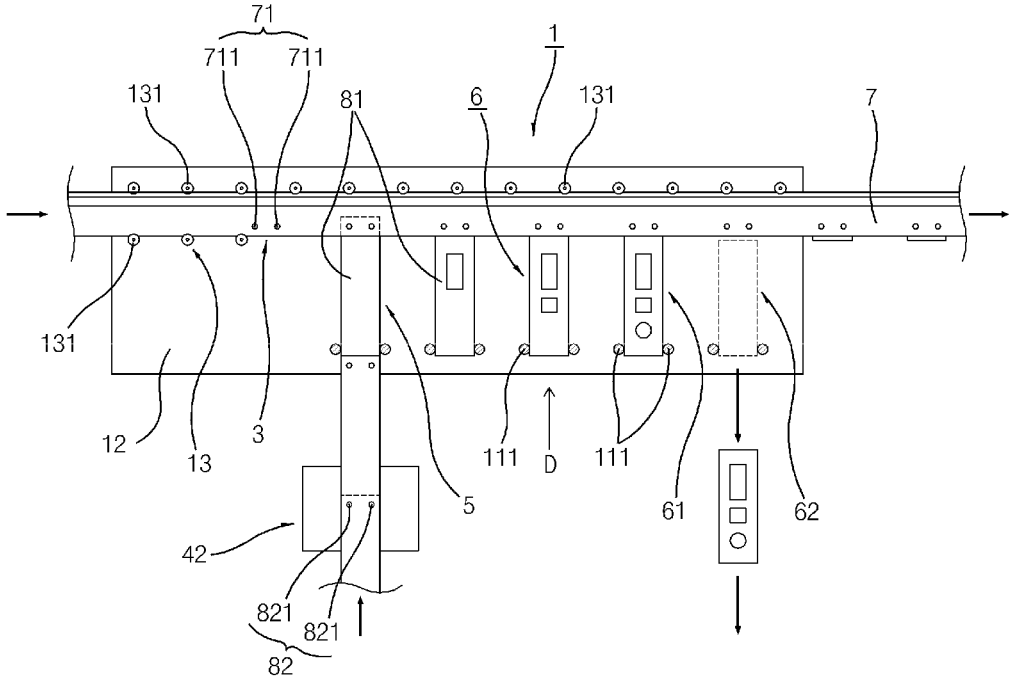

[FIG. 3]
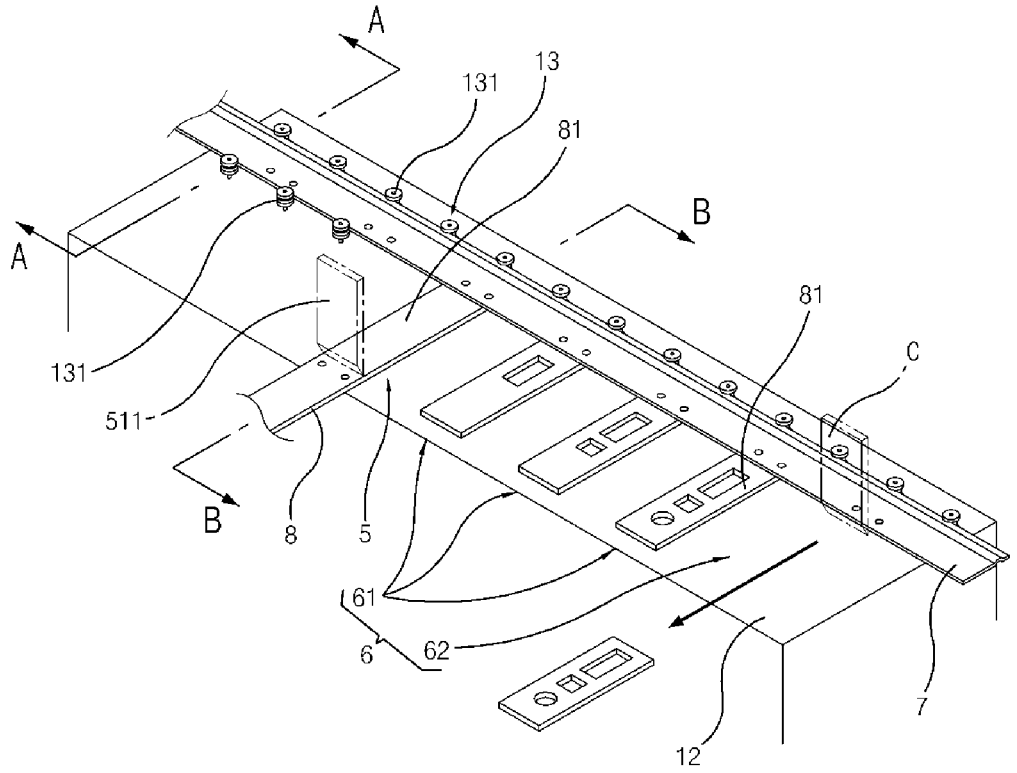

[FIG. 4]
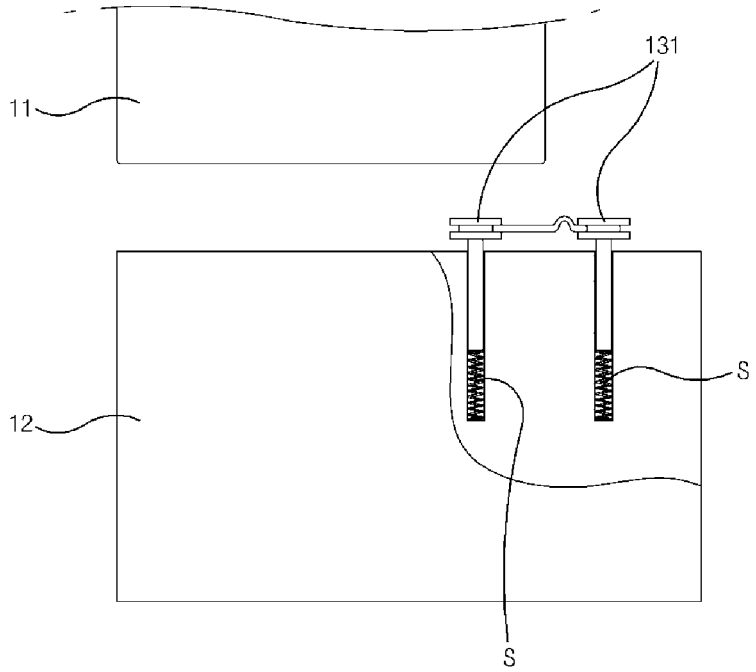

[FIG. 5A]
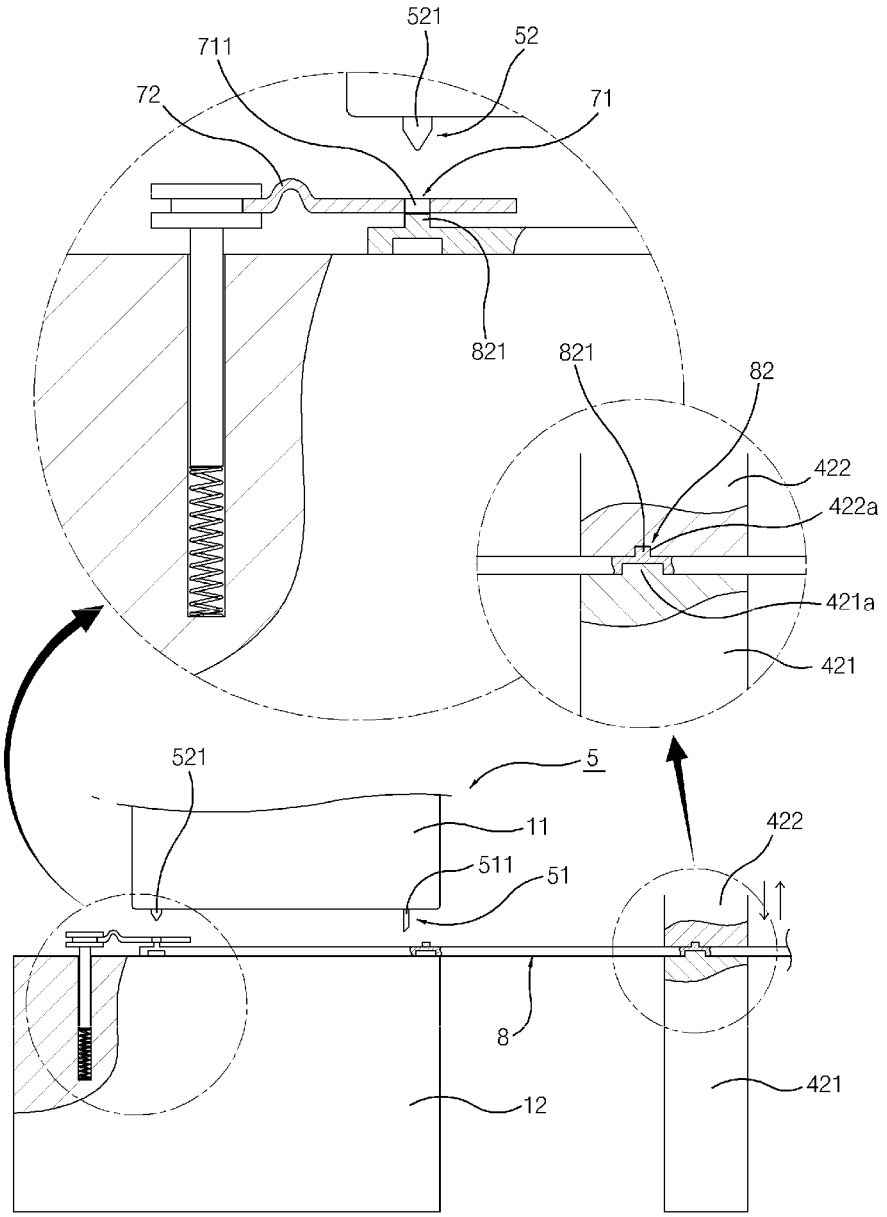

[FIG. 5B]
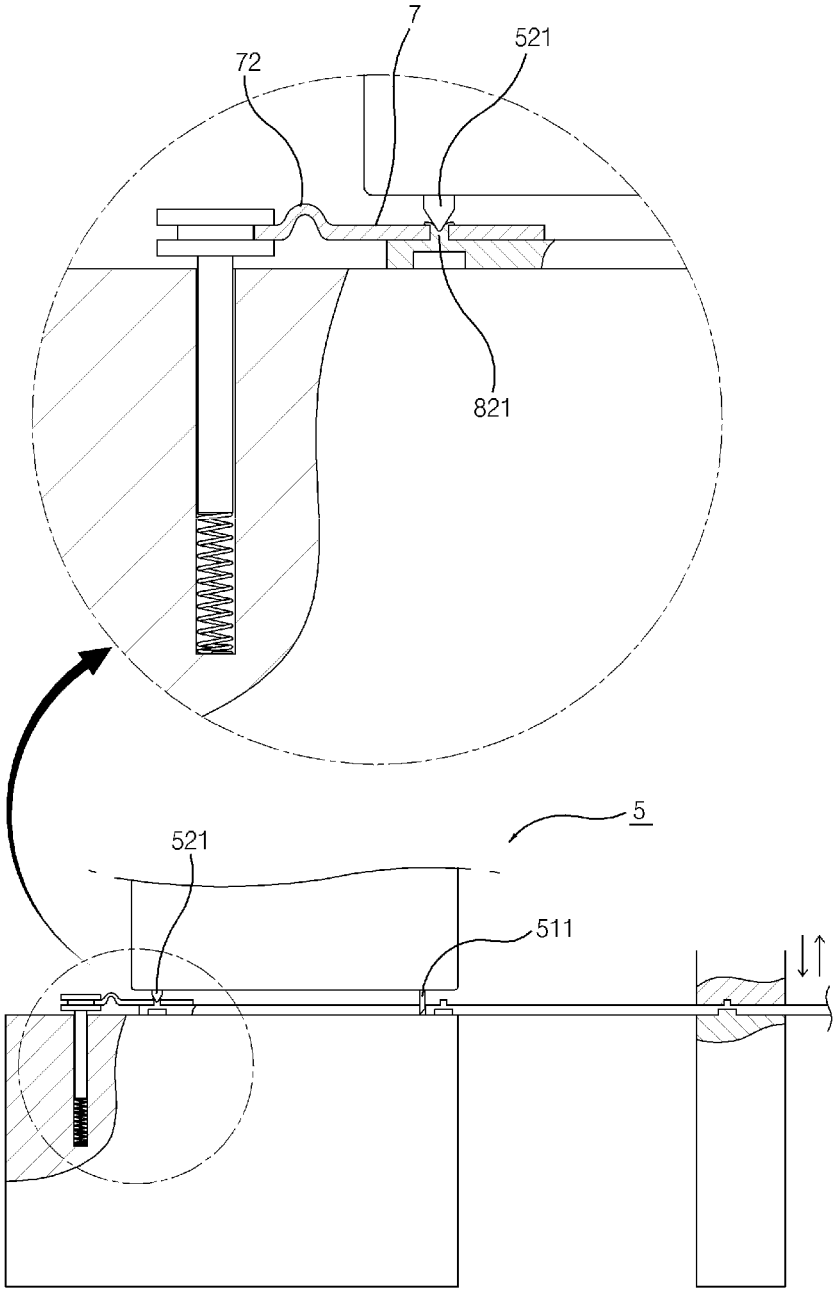

[FIG. 6A]
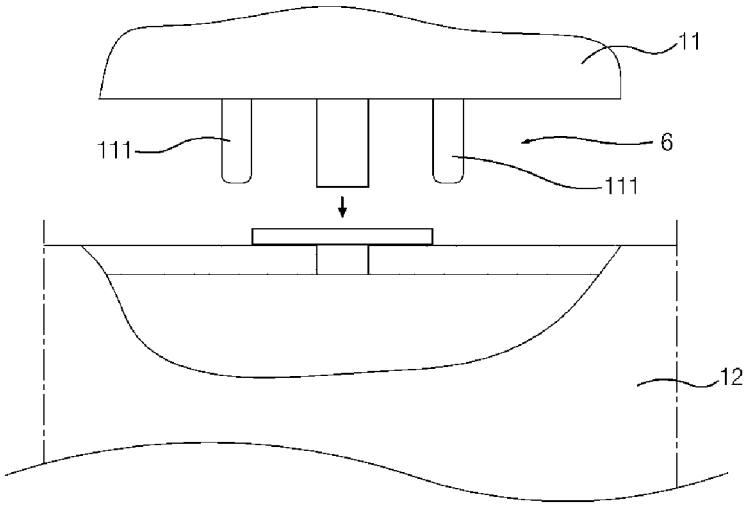

[FIG. 6B]
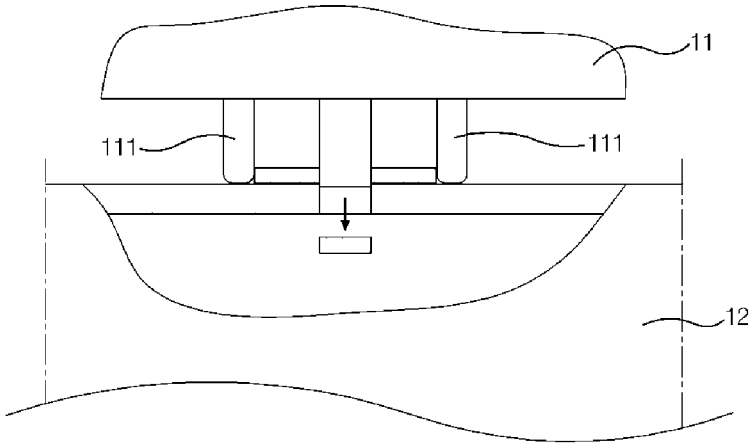

[FIG. 7]
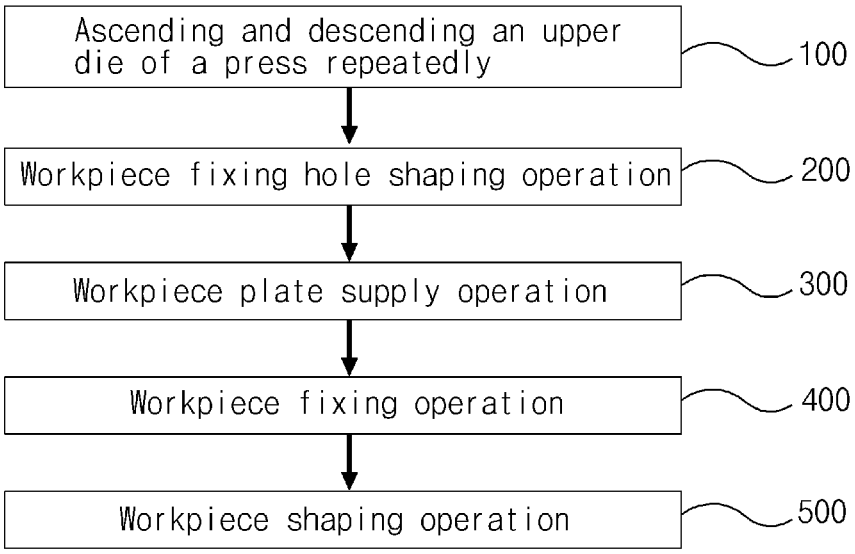

FORGING METHOD AND FORGING APPARATUS

CROSS-REFERENCE TO RELATED APPLICATION

The present application is a U.S. National Stage of International Patent Application No. PCT/KR2016/008657 filed Aug. 8, 2016, which claims priority to and the benefit of Korean Patent Application No. 10-2016-0021681 filed in the Korean Intellectual Property Office on Feb. 24, 2016, the entire contents of which are incorporated herein by reference.

TECHNICAL FIELD

The present disclosure relates to a forging method and forging apparatus. More particularly, the present disclosure relates to a forging method and forging apparatus in which only a rear end of a workpiece is fixed to a tray plate that fixes the workpiece to reduce a front-rear direction width of the tray plate and thus to reduce an amount of the tray plate used during the workpiece shaping, and in which a compression shaping of the workpiece is performed while a minimum size workpiece required for a final product is fixed on the tray plate such that an amount of the workpiece as used can be minimized.

BACKGROUND ART

Generally, forging is a shaping method that presses a workpiece such as iron or non-ferrous metal to cause plastic deformation thereof. The forging work for compressing the workpiece is performed by a press machine (hereinafter referred to as a "press") including an upper die and a lower die.

Further, conventionally, when a workpiece is subjected to plastic deformation via forging, the forging may be classified into a single forging method and a sequential forging method. In the single forging method, a forged product is obtained by compressing a single workpiece once. Further, in the sequential forging method, a long plate workpiece is injected to a progressive press to form a forged product via multiple sequential forgings.

In this connection, an example of the conventional sequential forging method is disclosed in Korean Patent No. 10-1513723, which was previously filed by the present applicant and tiled as a forging method and forging apparatus for different workpieces (hereinafter referred to as a conventional forging method and conventional forging apparatus).

The conventional forging method includes preparing a press comprising upper and lower dies, each of which has a punching part, a cutting/pressing part, a pressing part, and an extraction part that are sequentially provided from one side to an opposite side thereof, and repeatedly elevating the upper die; continuously forming workpiece passing/fixing parts in a tray plate through the punching part by supplying a tray plate by one pitch from one side to an opposite side towards an upper side of the lower die whenever the upper die is lifted; introducing workpiece plates from a front side to upper sides of the workpiece passing/fixing parts whenever the upper die is lifted, repeatedly cutting the workpiece plates through the cutting/pressing part, continuously introducing the cut workpieces to upper sides of the workpiece passing/fixing parts, pressing the introduced workpiece, and fixing the workpieces to the workpiece passing/fixing parts; pressing the workpieces that are moved while being fixed to the tray plate, through the pressing part; and separating the workpieces that have been formed while being fixed to the tray plate, and extracting the separated workpieces to a lower side.

The conventional forging apparatus includes a press having upper and lower dies; a tray plate supply assembly that supplies a tray plate by one pitch from one side to an opposite side towards an upper side of the lower die; punching parts that are provided on sides of the upper and lower dies to continuously form workpiece passing/fixing parts in the tray plate; a workpiece plate supply assembly that is provided in front of the press to supply a workpiece plate to the upper sides of the workpiece passing/fixing parts by one pitch; cutting/pressing parts that are provided in the upper and lower dies at opposite sides of the punching parts to repeatedly cut the workpiece plate introduced to upper sides of the workpiece passing/fixing parts and fix the cut workpieces to the workpiece passing/fixing parts after pressing the workpieces; pressing parts that are provided in the upper and lower dies at opposite sides of the cutting/pressing parts to press the moved workpieces; and extraction parts that are provided in the upper and lower dies at opposite sides of the pressing parts to separate and extract the formed workpieces.

However, in the conventional forging method and forging apparatus constructed as described above, the workpiece passing/fixing parts are drilled in the tray plate and then the workpiece is inserted and fixed in the workpiece passing/fixing parts. In this case, a front-rear width of the tray plate should be wider than a front-rear width of the workpiece. As a result, when the workpiece is shaped, an amount of the tray plate discarded after use is large, resulting in a problem that a manufacturing cost of a final product is increased.

Prior Art Literature

Patent Document 1: Korean Patent No. 10-1513723 (Apr. 14, 2014) titled as "Forging method and forging apparatus for different workpieces".

DETAILED DESCRIPTION OF THE INVENTION

Technical Problem

The present disclosure is intended to overcome the above conventional problem.

Thus, a purpose of the present disclosure is to provide a forging method and forging apparatus in which only a rear end of a workpiece is fixed to a tray plate that fixes the workpiece to reduce a front-rear direction width of the tray plate and thus to reduce an amount of the tray plate used during the workpiece shaping, and in which a compression shaping of the workpiece is performed while a minimum size workpiece required for a final product is fixed on the tray plate such that an amount of the workpiece as used can be minimized.

Further, another purpose of the present disclosure is to provide a forging method and forging apparatus in which only the rear end of the workpiece is fixed to the tray plate, and, thus, a chip or burr generated by drilling the workpiece fixing hole in the tray plate does not affect the shaped part of the workpiece at all. Therefore, in the compression-shaping of the workpiece, this may prevent the shaping failure due to the influence of chips or burrs generated during the boring of the tray plate, thereby to achieve an advantage of minimizing a defective shaping rate.

Further, still another purpose of the present disclosure is to provide a forging method and forging apparatus in which the workpieces are fixed to the tray plate such that the workpieces are arranged to be spaced apart from each other in a left-right direction. Thus, although the workpiece is expanded in the lateral direction during the compression-shaping of each workpiece, the expansion may not impose any interference to neighboring workpieces. As a result, working accuracy can be improved during the compression-shaping of each workpiece, thereby shaping a high-precision product.

Technical Solution

In one aspect, the present disclosure provides a forging method comprising: an operation of ascending and descending an upper die of a press repeatedly, wherein the press includes the upper and lower dies sequentially having a punching unit, a cutting and pressing and fixing assembly, and a pressing and shaping unit from one side of the press to an opposite side of the press; a workpiece fixing hole shaping operation in which each time the upper die is raised, a tray plate is supplied by one pitch toward a rear end of a top of the lower die so as to be spaced apart from a top face of the lower die in such a manner that the tray plate can ascend and descend, and at the same time, a workpiece fixing hole is continuously punctured in the tray plate via the punching unit; a workpiece plate supply operation in which each time the upper die is raised, a workpiece plate is supplied from a front by one pitch to a position below the workpiece fixing hole of the tray plate located on the cutting and pressing and fixing assembly, and, at the same time, a through-protrusion to pass through the workpiece fixing hole is formed on a top of a rear end of a portion of the workpiece plate corresponding to the supplied one pitch; a workpiece fixing operation in which the workpiece plate supplied into the position below the workpiece fixing hole located on the cutting and pressing and fixing assembly is cut by one pitch, and, then, the through-protrusion formed on the rear end of the cut workpiece passes through the workpiece fixing hole and is compressed and fixed into the workpiece fixing hole; and a workpiece shaping operation in which the workpiece moved while being fixed to the tray plate is compression-shaped by the pressing and shaping unit.

Further, in the forging method, in the workpiece shaping operation, the workpiece is shaped via one or more workpiece shaping units, and then, a rear end or periphery of the workpiece shaped via the one or more workpiece shaping units is compression-cut by a vertical cutter of a last shaping unit to complete a last product.

Further, in another aspect, the present disclosure provides a forging apparatus comprising: a press having upper and lower dies; a tray plate supply assembly configured to supply, by one pitch, a tray plate from one side of the press to an opposite side of the press towards a top of the lower die such that the tray plate can ascend and descend each time the upper die is raised; a punching unit disposed on the upper and lower dies at one side thereof to continuously form a workpiece fixing hole in the tray plate; a workpiece plate supply assembly disposed in front of an opposite side of the punching unit for feeding the workpiece plate by one pitch to a position below the workpiece fixing hole defined in the tray plate, wherein the workpiece plate supply assembly forms a through-protrusion to pass through the workpiece fixing hole on a top of a rear end of a portion of the workpiece plate corresponding to the fed one pitch; a cutting and pressing and fixing assembly provided on the upper and lower die at an opposite side of the punching unit for cutting the workpiece plate to be fed to the position below the workpiece fixing hole of the tray plate by one pitch and for pressing and fixing the through-protrusion formed on the rear end of the cut workpiece into the workpiece fixing hole; and a pressing and shaping unit disposed on the upper and lower dies at an opposite side of the cutting and pressing and fixing assembly for compressing and shaping the fed workpiece.

Further, in the forging apparatus, the tray plate supply assembly includes an ascending and descending guide configured for supplying the tray plate away from the top face of the lower die and allowing the tray plate to move up and down.

Further, in the forging apparatus, the ascending and descending guide includes a plurality of ascending and descending guide rolls, wherein the plurality of ascending and descending guide rolls are formed on each of front and rear ends of the lower die and are arranged at intervals in a right-left direction, wherein the plurality of ascending and descending guide rolls are maintained in an ascended position via an underlying spring S while ascending and descending, wherein the plurality of ascending and descending guide rolls are in close contact with a front end or a rear end of the tray plate.

Further, in the forging apparatus, the workpiece fixing hole includes a plurality of fixing holes, wherein the through-protrusion includes a plurality of through fixing pins, wherein the plurality of through fixing pins penetrates the fixing holes constituting the workpiece fixing hole and then a top of the plurality of through fixing pins is compressed and extended by the cutting and pressing and fixing assembly.

Further, in the forging apparatus, the workpiece plate supply assembly includes: a workpiece plate supply unit disposed in front of the press having the cutting and pressing and fixing assembly for supplying the workpiece plate by one pitch; and protrusion forging means disposed between the workpiece plate supply unit and the cutting and pressing and fixing assembly for shaping the through-protrusion.

Further, in the forging apparatus, the protrusion forging means includes a fixed lower die and an ascending and descending upper die, wherein the fixed lower die has, at a top of the fixed die, a protrusion-shaping convex portion; wherein the ascending and descending upper die is disposed above the fixed lower die and has a protrusion-shaping concave portion at a bottom of the die, wherein the ascending and descending upper die repeatedly shapes the through-protrusions in a repetitive compression manner via iterative ascending and descending.

Further, in the forging apparatus, the apparatus further includes a plurality of guide pins protruding downward from a lower portion of the upper die and being spacedly arranged at intervals in a left-right direction, wherein the plurality of guide pins are brought into close contact with both sides of the workpiece when the upper die is lowered, thereby preventing the workpiece from being shaken in the left-right direction.

Further, in the forging apparatus, the cutting and pressing and fixing assembly includes: a workpiece cutting unit provided with a workpiece cutter at a lower front of the upper die to cut the workpiece plate via a lowering of the upper die; and a workpiece pressing and fixing unit provided at a rear end of the workpiece cutting unit, wherein the workpiece pressing and fixing unit has a compressing pin at a bottom of the upper die, wherein the workpiece pressing and fixing unit pushes the through-protrusion formed on the rear end of the workpiece into the workpiece fixing hole and compresses and fixes a top of the through-protrusion into the workpiece fixing hole via the lowering of the upper die.

Further, in the forging apparatus, the pressing and shaping unit includes: at least one workpiece shaping unit provided on the upper and lower dies for shaping the workpiece via compression; and a last shaping unit provided on the upper and lower dies for compress-cutting, via a vertical cutter, a rear end or a periphery of the workpiece shaped via the one or more workpiece shaping units, thereby obtaining a final product.

Further, in the forging apparatus, the tray plate includes a convex bent portion formed in a length-direction for reinforcing the tray plate.

Further, in the forging apparatus, the workpiece is made of metal, wherein the tray plate is made of a metal having a lower ductility than the workpiece.

Further, in the forging apparatus, the workpiece is made of aluminum or copper, wherein the tray plate is made of iron or stainless steel.

Advantageous Effects of the Invention

In accordance with the present disclosure, only a rear end of a workpiece is fixed to a tray plate that fixes the workpiece to reduce a front-rear direction width of the tray plate and thus to reduce an amount of the tray plate used during the workpiece shaping. Further, a compression shaping of the workpiece is performed while a minimum size workpiece required for a final product is fixed on the tray plate such that an amount of the workpiece as used can be minimized.

Further, in accordance with the present disclosure, only the rear end of the workpiece is fixed to the tray plate, and, thus, a chip or burr generated by drilling the workpiece fixing hole in the tray plate does not affect the shaped part of the workpiece at all. Therefore, in the compression-shaping of the workpiece, this may prevent the shaping failure due to the influence of chips or burrs generated during the boring of the tray plate, thereby to achieve an advantage of minimizing a defective shaping rate.

Furthermore, in accordance with the present disclosure, the workpieces are fixed to the tray plate such that the workpieces are arranged to be spaced apart from each other in a left-right direction. Thus, although the workpiece is expanded in the lateral direction during the compression-shaping of each workpiece, the expansion may not impose any interference to neighboring workpieces. As a result, working accuracy can be improved during the compression-shaping of each workpiece, thereby shaping a high-precision product.

DESCRIPTION OF THE DRAWINGS

FIG. 1 is a schematic perspective view showing a forging apparatus according to the present disclosure.

FIG. 2 is a top view of a lower die showing main portions according to the present disclosure.

FIG. 3 is a schematic perspective view of main portions according to the present disclosure.

FIG. 4 is a cross-sectional view taken along a line A-A of FIG. 1.

FIG. 5A shows a state before a workpiece is fixed.

FIG. 5B shows a workpiece in a fixed state.

FIG. 6A shows an upper die in a raised state.

FIG. 6B shows a state where the upper die is lowered.

FIG. 7 is a flow chart of a forging method according to the present disclosure.

BEST MODE

Hereinafter, a preferred embodiment of the present disclosure will be described in detail with reference to the accompanying drawings. However, It should be understood that the present disclosure may be implemented in a number of different forms and the present disclosure is not limited to embodiments as described.

FIG. 1 is a schematic perspective view showing a forging apparatus according to the present disclosure. FIG. 2 is a top view of a lower die showing main portions according to the present disclosure. FIG. 3 is a schematic perspective view of main portions according to the present disclosure. FIG. 4 is a cross-sectional view taken along a line A-A of FIG. 1. Each of FIGS. 5A and 5B shows a partial cross-sectional view taken along a line B-B of FIG. 1. FIG. 5A shows a state before a workpiece is fixed. FIG. 5B shows a workpiece in a fixed state. Each of FIGS. 6A and 6B is a partial schematic view seen from a part D of FIG. 2. FIG. 6A shows an upper die in a raised state. FIG. 6B shows a state where the upper die is lowered.

As illustrated in the drawings, an apparatus for forging a workpiece according to the present disclosure includes a press 1 having upper and lower dies 11 and 12, and includes a tray plate supply assembly 2 that supplies, by one pitch, a tray plate 7 in a raised or lowered manner from one side (hereinafter, a left side of the drawings will be referred to as one side and a right side of the drawings that is an opposite side thereto will be referred to an opposite side) to the opposite side towards a rear end of a top of the lower die 12 and to be spaced from a top face of the lower die 12.

The forging apparatus according to the present disclosure includes a punching unit 3 disposed on the upper and lower dies 11 and 12 at one side thereof to continuously form a workpiece fixing hole 71 in the tray plate 7; a workpiece plate supply assembly 4 provided in front of an opposite side of the punching unit 3 for feeding a workpiece plate 8 at one pitch to a position below the workpiece fixing hole 71 defined in the tray plate 7, wherein the workpiece plate supply assembly 4 forms a through-protrusion 82 to pass through the workpiece fixing hole 71 at a top of a rear end of a portion of the workpiece plate 8 corresponding to the fed one pitch; a cutting and pressing and fixing assembly 5 provided on the upper and lower die 11 and 12 at the opposite side of the punching unit 3 for cutting the workpiece plate 8 to be fed to the position below the workpiece fixing hole 71 of the tray plate 7 by one pitch and for pressing and fixing the through-protrusion 82 formed on the rear end of the cut workpiece 81 into the workpiece fixing hole 71; and a pressing and shaping unit 6 disposed on the upper and lower dies 11 and 12 at the opposite side of the cutting and pressing and fixing assembly 5 for compressing and shaping the moved workpiece 81.

Further, the press 1 has the upper and lower dies 11 and 12. The upper die 11 is raised and lowered from and toward a top of the lower die 12. A configuration in which the upper die 11 is moved upward and downward is already known, and a detailed description thereof will be omitted.

Further, a plurality of guide pins 111 protruding downward from a front of a lower portion of the upper die 11 constituting the press 1 are arranged at intervals in a left-right direction. The plurality of guide pins 111 are brought into close contact with both sides of the workpiece 81 when the upper die 11 is lowered, thereby preventing the workpiece 81 from being shaken in the left-right direction.

Further, the tray plate supply assembly 2 constituting the apparatus of the present disclosure is spaced from one side of the press 1 to supply the tray plate 7 wound on a roller to the top face of the lower die 12 of the press 1. The tray plate supply assembly 2 feeds the tray plate 7 from one side to the opposite side by one pitch to the top face of the lower die 12 via driving of upper and lower rollers associated with each other.

The tray plate supply assembly 2 further includes an ascending and descending guide 13 for supplying the tray plate 7 away from the top face of the lower die 12 and allowing the tray plate to move up and down.

The ascending and descending guide 13 includes a plurality of ascending and descending guide rolls 131. The plurality of ascending and descending guide rolls 131 are formed on each of the front and rear ends of the lower die 12 and arranged at intervals in a right-left direction. The plurality of ascending and descending guide rolls 131 are maintained in an ascended position via an underlying spring S while ascending and descending. The plurality of ascending and descending guide rolls 131 are in close contact with the front end or the rear end of the tray plate 7. That is, when the upper die 11 is lowered, the tray plate 7 is moved downward and is brought into close contact with the top face of the lower die 12.

Thus, the apparatus according to the present disclosure feeds the tray plate 7 to be spaced apart from the top face of the lower die 12 via the ascending and descending guide 13 including the ascending and descending guide rolls 131. As a result, when the compression by the cutting and pressing and fixing assembly 5 causes the through-protrusion 82 formed in the rear end of the workpiece 81 to pass through and be fixed to the workpiece fixing hole 71 defined in the tray plate 7, the through-protrusion 82 can be smoothly inserted into the workpiece fixing hole 71.

In one example, the tray plate 7 includes a convex bent portion 72 formed in a length-direction for reinforcing the tray plate 7. The convex bent portion 72 prevents the tray plate 7 from being twisted or warped.

Further, the punching unit 3 constituting the apparatus according to the present disclosure is disposed on the upper and lower dies 11 and 12 at one side thereof. The punching unit 3 serves to continuously form a workpiece fixing hole 71 in the tray plate 7. Further, the workpiece fixing hole 71 includes a plurality of fixing holes 711 for firmly fixing the workpiece 81.

In addition, the punching unit 3 includes a plurality of punchers (not shown) protruding downward from the upper die 11, and a plurality of discharge holes (not shown) defined in the lower die 12 for receiving a piece punched by with the puncher.

Further, the workpiece plate supply assembly 4 constituting the apparatus of the present disclosure is spaced from the front of the press 1. The workpiece plate supply assembly 4 serves to supply the workpiece plate 8 wound on a roller to the cutting and pressing and fixing assembly 5. In addition, the workpiece plate supply assembly 4 is disposed in front of the cutting and pressing and fixing assembly 5. The workpiece plate supply assembly 4 may include a workpiece plate supply unit 41 for supplying the workpiece plate 8 at a pitch and protrusion forging means 42 disposed between the workpiece plate supply unit 41 and the cutting and pressing and fixing assembly 5 for shaping the through-protrusion 82.

The workpiece plate supply unit 41 feeds from a front the workpiece plate 8 at one pitch above a through-fixing portion for the workpiece 81 via the driving of upper and lower rollers interlocked with each other. The workpiece plate supply unit 41 is already known, and a detailed description thereof will be omitted.

The protrusion forging means 42 may shape the protrusion on the workpiece plate 8 by compressing the workpiece plate 8. To this end, the protrusion forging means 42 may include a fixed lower die 421 and an ascending and descending upper die 422. The fixed lower die 421 has, at a top, a protrusion-shaping convex portion 421*a*. The ascending and descending upper die 422 is disposed above the fixed lower die 421, and has a protrusion-shaping concave portion 422*a* at a bottom thereof. The ascending and descending upper die 422 may shape the through-protrusions 82 in a repetitive compression manner via iterative ascending and descending. In addition, the arrangement for ascending and descending the ascending and descending upper die 422 and the movement thereof are already known, and, thus, a detailed description thereof will be omitted.

In particular, the through-protrusion 82 includes a plurality of through fixing pins 821, wherein the plurality of through fixing pins 821 penetrates the fixing holes 711 constituting the workpiece fixing hole 71 and then a top of the plurality of through fixing pins 821 is compressed and extended by the cutting and pressing and fixing assembly 5.

Further, the cutting and pressing and fixing assembly 5 constituting the apparatus according to the present disclosure is constructed to repeatedly cut the workpiece plate 8 inserted into the cutting and pressing and fixing assembly 5, and to press and fix the rear end of the cut workpiece 81 end to the tray plate 7.

To this end, the cutting and pressing and fixing assembly 5 includes a workpiece cutting unit 51 provided with a workpiece cutter 511 at a lower front of the upper die 11 to cut the workpiece plate 8 via a lowering of the upper die 11, and a workpiece pressing and fixing unit 52 provided at a rear end of the workpiece cutting unit 51, wherein the workpiece pressing and fixing unit 52 has a compressing pin 521 at a bottom of the upper die 11, wherein the workpiece pressing and fixing unit 52 pushes the through-protrusion 82 formed in the rear end of the workpiece 81 into the workpiece fixing hole 71 and compresses and fixes a top of the through-protrusion 82 into the workpiece fixing hole 71 via the lowering of the upper die 11. That is, when the compressing pin 521 is lowered to compress the top of the through-protrusion 82, the top of the through-protrusion 82 extends like a rivet, such that the through-protrusion 82 is permanently inserted and fixed within the workpiece fixing hole 71.

In addition, the workpiece 81 may be made of metal. The tray plate 7 may be preferably made of a metal having a lower ductility than the workpiece 81. Further, the workpiece 81 may be made of aluminum or copper. The tray plate 7 may be made of iron or stainless steel.

Thus, according to the present disclosure, only the rear end of the workpiece 81 is fixed to the tray plate 7. Thus, a chip or burr generated by drilling the workpiece fixing hole 71 in the tray plate 7 does not affect the shaped part of the workpiece 81 at all. Therefore, according to the present disclosure, in the compression-shaping of the workpiece 81, this may prevent the shaping failure due to the influence of chips or burrs generated during the boring of the tray plate 7, thereby to achieve an advantage of minimizing a defective shaping rate.

Further, the pressing and shaping unit constituting the apparatus according to the present disclosure is provided on the upper and lower dies 11 and 12 to compress-shape the moved workpiece 81.

To this end, the pressing and shaping unit includes at least one workpiece shaping unit 61 provided at one side of the press for shaping the workpiece 81 via compression; and a last shaping unit 62 provided on the upper and lower dies 11 and 12 at the opposite side of a single workpiece shaping unit 61 and of a workpiece shaping unit 61 located at the most opposite side among the plurality of workpiece shaping units 61, wherein the last shaping unit 62 compresses and cuts, via a vertical cutter C, a rear end or a periphery of the workpiece 81, which has been shaped via the one or more workpiece shaping units 61, thereby obtaining a final product.

Hereinafter, the forging method for different workpieces 81 according to the present disclosure will be described.

FIG. 7 is a flow chart of the forging method according to the present disclosure.

As shown in FIGS. 1 to 7, the forging method according to the present disclosure may be performed using the forging apparatus described above, or may be performed using another forging apparatus. In describing the forging method according to the present disclosure, an example using the forging apparatus according to the present disclosure as described above is considered.

Accordingly, the forging method according to the present disclosure first performs an operation 100 of ascending and descending the upper die 11 of press 1 repeatedly, wherein the press 1 includes the upper and lower dies 11 and 12, which sequentially have the punching unit 3, the cutting and pressing and fixing assembly 5, and the pressing and shaping unit 6 from one side of the press to the opposite side of the press.

Next, the method performs a workpiece fixing hole shaping operation 200 in which each time the upper die 11 is raised, the tray plate 7 is supplied by one pitch toward a rear end of a top of the lower die 12 so as to be spaced apart from a top face of the lower die 12 in such a manner that the tray plate 7 can ascend and descend, and at the same time, the workpiece fixing hole 71 is continuously punctured in the tray plate 7 via the punching unit 3.

Next, the method performs a workpiece plate supply operation 300 in which each time the upper die 11 is raised, the workpiece plate 8 is supplied from a front by one pitch to a position below the workpiece fixing hole 71 of the tray plate 7 located on the cutting and pressing and fixing assembly 5, and, at the same time, the through-protrusion 82 to pass through the workpiece fixing hole 71 is defined on a top of a rear end of a portion of the workpiece plate 8 corresponding to the supplied one pitch.

In this connection, the workpiece 81 may be made of metal. The tray plate 7 may be preferably made of a metal having a lower ductility than the workpiece 81. Further, the workpiece 81 may be made of aluminum or copper. The tray plate 7 may be made of iron or stainless steel.

Next, the method performs a workpiece fixing operation 400 in which the workpiece plate 8 supplied into the position below the workpiece fixing hole 71 located on the cutting and pressing and fixing assembly 5 is cut by one pitch, and, then, the through-protrusion 82 formed on the rear end of the cut workpiece 81 passes through the workpiece fixing hole 71 and is compressed and fixed into the workpiece fixing hole 71. That is, the workpiece fixing operation 400 is repeatedly performed in a process of repeatedly ascending and descending the upper die of the press including the upper and lower dies. The operation 400 is preferably repeatedly performed in a process of supplying the workpiece plate by one pitch.

Next, the method performs a workpiece shaping operation 500 in which the workpiece 81, which is moved while being fixed to the tray plate 7, is compression-shaped by the pressing and shaping unit 6. Thereby, the compression-shaping of the workpieces 81 is completed.

Particularly, in the workpiece shaping operation 500, in order to compress-shape the workpiece 81 in various shapes, the workpiece 81 is shaped via one or more workpiece shaping units 61, and then, the rear end or periphery of the workpiece 81, which has been shaped via the one or more workpiece shaping units 61, is compression-cut by the vertical cutter C of the last shaping unit 62. This completes the last product.

Therefore, according to the forging method and forging apparatus according to the present disclosure, only the rear end of the workpiece 81 is fixed to the tray plate 7 which fixes the workpiece 81. As a result, the front-rear directional width of the tray plate 7 is reduced. This can reduce the amount of the tray plate 7 used when shaping the workpiece 81, thereby lowering the manufacturing cost of the product. The forging apparatus according to the present disclosure fixes the workpiece 81 having the minimum size required for the last product to the tray plate 7 and then compress-shapes the product. Thus, the use amount of the workpiece 81 can be minimized, and thus, the manufacturing cost of the product can be reduced.

Further, according to the forging method and forging apparatus according to the present disclosure, the workpieces 81 are fixed to the tray plate 7 such that the workpieces 81 are arranged to be spaced apart from each other in a left-right direction. Thus, although the workpiece 81 is expanded in the lateral direction during the compression-shaping of each workpiece 81, the expansion may not impose any interference to neighboring workpieces 81. As a result, working accuracy can be improved during the compression-shaping of each workpiece 81, thereby shaping a high-precision product.

While the preferred embodiments of the present disclosure have been described, the present disclosure can employ various changes, modifications, and equivalents. It is clear that the present disclosure can equally be applied via modifications of the embodiments described above. Therefore, the above description does not limit the scope of the present disclosure as defined by the limitations of the following claims.

Although the detailed description of the present disclosure has been provided with reference to the specific embodiments, it will be apparent to those skilled in the art that various modifications are possible without departing from the scope of the present disclosure.

REFERENCE NUMERALS

1: press
11: upper die
111: guide pin
12: lower die
13: ascending and descending guide
131: ascending and descending guide roll, S : spring
2: tray plate supply assembly
3: punching unit
4: workpiece plate supply assembly
41: workpiece plate supply unit
42: protrusion forging means

421: fixing lower die, 421*a*: shaping convex portion,
422: ascending and descending upper die, 422*a*: shaping concave portion
5: cutting and pressing and fixing assembly
51: workpiece cutting unit
511: workpiece cutter
52: workpiece pressing and fixing unit
521: compressing pin
6: press-shaping unit
61: workpiece shaping unit
62: last shaping unit
7: tray plate
71: workpiece fixing hole
711: fixing holes
72: convex bent portion
8: workpiece plate
81: workpiece
82: through-protrusion
821: through fixing pin
C: vertical cutter

The invention claimed is:

1. A forging method comprising:

an operation of ascending and descending an upper die of a press repeatedly, wherein the press includes the upper die and a lower die sequentially having a punching unit, a cutting and pressing and fixing assembly, and a pressing and shaping unit from one side of the press to an opposite side of the press;

a workpiece fixing hole shaping operation in which each time the upper die is raised, a tray plate is moved by a first distance toward a rear end of a top of the lower die so as to be spaced apart from a top face of the lower die in such a manner that the tray plate can ascend and descend, and at the same time, a workpiece fixing hole is continuously punctured in the tray plate via the punching unit;

a workpiece plate supply operation in which each time the upper die is raised, a workpiece plate is moved from a front by a second distance to a position below the workpiece fixing hole of the tray plate, and, at the same time, a through-protrusion to pass through the workpiece fixing hole is formed on a top of a portion of the workpiece plate;

a workpiece fixing operation in which the workpiece plate supplied into the position below the workpiece fixing hole is cut to form a workpiece, and, then, the through-protrusion formed on a rear end of the workpiece passes through the workpiece fixing hole and is compressed and fixed into the workpiece fixing hole; and a workpiece shaping operation in which the workpiece that is moved while being fixed to the tray plate is compression-shaped by the pressing and shaping unit, wherein in the workpiece shaping operation, the workpiece is shaped, and then, the rear end of the workpiece is compression-cut by a vertical cutter of a last shaping unit to obtain a last product.

2. A forging apparatus comprising:

a press having upper and lower dies;

a tray plate supply assembly configured to move, by a first distance, a tray plate towards a top of the lower die such that the tray plate can ascend and descend each time the upper die is raised;

a punching unit disposed on the upper and lower dies at one side of the press to continuously form a workpiece fixing hole in the tray plate;

a workpiece plate supply assembly disposed in front of an a first side of the punching unit for moving a workpiece plate by a second distance to a position below the workpiece fixing hole defined in the tray plate, wherein the workpiece plate supply assembly forms a through-protrusion to pass through the workpiece fixing hole on a top of a portion of the workpiece plate;

a cutting and pressing and fixing assembly provided on the upper and lower dies at a second side of the punching unit for cutting the workpiece plate to form a workpiece and for pressing and fixing the through-protrusion formed on a rear end of the workpiece into the workpiece fixing hole; and a pressing and shaping unit disposed on the upper and lower dies at a side of the cutting and pressing and fixing assembly for compressing and shaping the workpiece, wherein the pressing and shaping unit includes a last shaping unit provided on the upper and lower dies for compress-cutting, via a vertical cutter, the rear end of the workpiece, thereby obtaining a final product.

3. The forging apparatus of claim 2, wherein the tray plate supply assembly includes an ascending and descending guide configured for supplying the tray plate away from the top face of the lower die and allowing the tray plate to move up and down.

4. The forging apparatus of claim 3, wherein the ascending and descending guide includes a plurality of ascending and descending guide rolls, wherein the plurality of ascending and descending guide rolls are formed on each of front and rear ends of the lower die and are arranged at intervals in a right-left direction, wherein the plurality of ascending and descending guide rolls are maintained in an ascended position via an underlying spring while ascending and descending, wherein the plurality of ascending and descending guide rolls are in contact with a front end or a rear end of the tray plate.

5. The forging apparatus of claim 2, wherein the workpiece fixing hole includes a plurality of fixing holes, wherein the through-protrusion includes a plurality of through fixing pins, wherein the plurality of through fixing pins penetrates the fixing holes constituting the workpiece fixing hole and then a top of the plurality of through fixing pins is compressed and extended by the cutting and pressing and fixing assembly.

6. The forging apparatus of claim 2, wherein the workpiece plate supply assembly includes:

a workpiece plate supply unit disposed in front of the press for moving the workpiece plate by the second distance; and protrusion forging means disposed between the workpiece plate supply unit and the cutting and pressing and fixing assembly for shaping the through-protrusion.

7. The forging apparatus of claim 6, wherein the protrusion forging means includes a fixed lower die and an ascending and descending upper die, wherein the fixed lower die has, at a top of the fixed lower die, a protrusion-shaping convex portion, wherein the ascending and descending upper die is disposed above the fixed lower die and has a protrusion-shaping concave portion at a bottom of the ascending and descending upper die, wherein the ascending and descending upper die repeatedly shapes the through-protrusions via iterative ascending and descending.

8. The forging apparatus of claim 2, wherein the apparatus further includes a plurality of guide pins protruding downward from a lower portion of the upper die and being arranged at intervals in a left-right direction, wherein the plurality of guide pins are brought into contact with both sides of the workpiece when the upper die is lowered, thereby preventing the workpiece from being shaken in the left-right direction.

9. The forging apparatus of claim 2, wherein the cutting and pressing and fixing assembly includes:

a workpiece cutting unit provided with a workpiece cutter at a lower front of the upper die to cut the workpiece plate via a lowering of the upper die; and a workpiece pressing and fixing unit provided at a rear end of the workpiece cutting unit, wherein the workpiece pressing and fixing unit has a compressing pin at a bottom of the upper die, wherein the workpiece pressing and fixing unit pushes the through-protrusion formed on the rear end of the workpiece into the workpiece fixing hole and compresses and fixes a top of the through-protrusion into the workpiece fixing hole via the lowering of the upper die.

10. The forging apparatus of claim 2, wherein the tray plate includes a convex bent portion formed in a length-direction for reinforcing the tray plate.

11. The forging apparatus of claim 2, wherein the workpiece is made of metal, wherein the tray plate is made of a metal having a lower ductility than the workpiece.

12. The forging apparatus of claim 2, wherein the workpiece is made of aluminum or copper, wherein the tray plate is made of iron or stainless steel.

* * * * *